US005503607A

United States Patent [19]

Lo

[11] Patent Number: 5,503,607

[45] Date of Patent: Apr. 2, 1996

[54] STEPPER

[76] Inventor: Peter K. Lo, No. 3, Ching-Cheng-Ssu St., Taichung City, Taiwan

[21] Appl. No.: 496,609

[22] Filed: Jun. 29, 1995

[51] Int. Cl.[6] ..... A63B 23/04

[52] U.S. Cl. ..... 482/52; 482/903

[58] Field of Search ..... 482/52, 53, 51, 482/903, 110, 902, 908, 900, 901, 57

[56] References Cited

U.S. PATENT DOCUMENTS

| | | | |
|---|---|---|---|
| 4,934,688 | 6/1990 | Lo | 482/53 |
| 5,139,469 | 8/1992 | Hennessey et al. | 482/52 |
| 5,336,143 | 8/1994 | Wu | 482/52 |
| 5,374,227 | 12/1994 | Webb | 482/52 |
| 5,385,063 | 1/1995 | Wang | 482/52 |

*Primary Examiner*—Stephen R. Crow
*Attorney, Agent, or Firm*—Oblon, Spivak, McClelland, Maier & Neustadt

[57] ABSTRACT

Each of a pair of pedal units of a stepper includes a hollow swing arm which has a front end portion formed with a through-hole and an elongated inclined slot, and a rear end portion mounted pivotally on a base frame. A connecting rod extends into the swing arm and has a front end portion formed with a transverse shaft that extends slidably into the inclined slot, and a rear end portion mounted pivotally on the base frame. A pedal body is provided with a spaced pair of downwardly extending connecting plates that confine the swing arm therebetween and that are connected pivotally to the swing arm at the through-hole of the latter. The connecting plates are further connected to the transverse shaft of the connecting rod. A transmission unit includes a drive shaft journalled on the base frame, two pinions mounted respectively on two end portions of the drive shaft, two elastic straps connected to the base frame, and two flexible racks respectively having a first end connected to one of the elastic straps and a second end connected to the swing arm of one of the pedal units. Each of the racks meshes with a respective one of the pinions. The elastic straps and the flexible racks maintain the swing arms of the pedal units in a normal upwardly inclining position.

7 Claims, 3 Drawing Sheets

STEPPER

BACKGROUND OF THE INVENTION

1. Field of the Invention

The invention relates to a stepper, more particularly to a stepper having pedal bodies that can be maintained in a substantially horizontal position when the stepper is in use.

2. Description of the Related Art

Referring to FIG. 1, a conventional stepper 10 is shown to comprise a base frame 11 with a handlebar assembly 110 mounted thereon, and a pair of pedal units (only one is shown) on two sides of the handlebar assembly 110. Each of the pedal units includes a swing arm 12 mounted pivotally on the base frame 11 at one end thereof and having a pedal body 13 mounted securely on the other end thereof. A magnet-type resistance unit 14 is mounted on the base frame 11. Each of a pair of tension springs 122 (only one is shown) has a first end connected to the handlebar assembly 110 and a second end connected to a respective one of the swing arms 12, thereby placing the swing arms 12 in normal upwardly inclining positions. Each of the swing arms 12 further has an intermediate section provided with a transverse shaft 120 for mounting rotatably a drive gear 121 thereon. First and second axles 150, 160 are journalled on the base frame 11, while a third axle 170 is mounted securely on the base frame 11. The first axle 150 has two gear wheels 151 (only one is shown) mounted thereon by means of unidirectional bearings (not shown). Each of two transmission chains 18 (only one is shown) is trained on one of the drive gears 121, one of the gear wheels 151 and on one of two gear wheels 17 (only one is shown) that are disposed rotatably on the third axle 170, and has a first end secured to the base frame 11 and a second end secured to the respective gear wheel 17. A first belt wheel 15 is mounted securely on the first axle 150 between the gear wheels 151. Second and third belt wheels 161, 16 are mounted securely on the second axle 160. A first endless drive belt 191 is trained between the first belt wheel 15 and the second belt wheel 161. A second endless drive belt 192 is trained between the third belt wheel 16 and a belt wheel 141 of the resistance unit 14. Two torsion springs 171 (only one is shown) are sleeved on the third axle 170 and serve to resist rotation of a corresponding one of the gear wheels 17 in a certain direction.

When pressure is applied on one of the pedal bodies 13, the corresponding swing arm 12 pivots downwardly, thereby stretching the corresponding tension spring 122. The drive gear 121 on the swing arm 12 pulls the corresponding transmission chain 18, thereby causing the corresponding gear wheels 151, 17 to rotate. At this stage, the first belt wheel 15 rotates to drive rotatably the second belt wheel 161 via the drive belt 191, and the third belt wheel 16 rotates to drive rotatably the belt wheel 141 of the resistance unit 14 via the drive belt 192. When the pressure on the pedal body 13 is released, the corresponding tension spring 122 contracts to cause upward pivoting movement of the corresponding swing arm 12. The torsion spring 171 associated with the corresponding gear wheel 17 causes the latter to rotate in an opposite direction to wind the corresponding transmission chain 18 thereon.

The drawbacks of the conventional stepper 10 are as follows:

1. Since the pedal bodies 13 are mounted securely on the swing arms 12, the pedal bodies 13 cannot be maintained in a substantially horizontal position when the conventional stepper 10 is in use. Thus, the conventional stepper 10 is not suitable for use by old people and by children since they may easily lose their balance when exercising on the conventional stepper 10.

2. In order to enable the resistance unit 14 to resist downward pivoting movement of the swing arms 12, two drive gears 121, two gear wheels 17, two transmission chains 18, and first, second and third belt wheels 15, 161, 16 are employed. Thus, the conventional stepper 10 is relatively complicated in construction and is relatively expensive due to the large number of components used in the connection between the resistance unit 14 and the swing arms 12.

SUMMARY OF THE INVENTION

Therefore, the main object of the present invention is to provide a stepper having pedal bodies that can be maintained in a substantially horizontal position when the stepper is in use.

Another object of the present invention is to provide a stepper which employs a fewer number of components to interconnect a resistance unit and pedal units thereof to result in a simpler and less expensive construction.

According to the present invention, a stepper comprises:

a base frame;

a pair of pedal units, each including: a hollow swing arm having a front end portion formed with a through-hole and an elongated inclined slot, and a rear end portion mounted pivotally on the base frame; a connecting rod extending into the swing arm and having a front end portion formed with a transverse shaft that extends slidably into the inclined slot, and a rear end portion mounted pivotally on the base frame; a pedal body provided with a spaced pair of downwardly extending connecting plates that confine the swing arm therebetween, each of the connecting plates being formed with a pair of through-holes to be aligned respectively with the through-hole and the inclined slot in the swing arm; a first pin extending through one of the through holes in the connecting plates and the through-hole in the swing arm to mount pivotally the pedal body to the swing arm; and a second pin extending through the other one of the through holes in the pedal body, the inclined slot in the swing arm and axially through the transverse shaft of the connecting rod;

a transmission unit including: a drive shaft journalled on the base frame; two pinions mounted respectively on two end portions of the drive shaft; two elastic straps, each having a first end connected to the base frame and a second end; and two flexible racks, each having a first end connected to the second end of a respective one of the elastic straps and a second end connected to the swing arm of a respective one of the pedal units, each of the racks meshing with a respective one of the pinions, the elastic straps and the flexible racks maintaining the swing arms of the pedal units in normal upwardly inclining positions, application of pressure on the pedal body of any one of the swing units resulting in downward pivoting movement of the swing unit and in rotation of the drive shaft due to movement of the respective one of the racks; and a resistance unit mounted on the base frame and connected to the drive shaft for providing resistance to rotation of the drive shaft.

In view of the unique arrangement of the swing arm, the connecting rod and the pedal body of each pedal unit on the base frame, the pedal bodies of the pedal units can be maintained in a substantially horizontal position when the stepper of this invention is in use.

BRIEF DESCRIPTION OF THE DRAWINGS

Other features and advantages of the present invention will become apparent in the following detailed description of the preferred embodiment, with reference to the accompanying drawings, of which.

DETAILED DESCRIPTION OF THE PREFERRED EMBODIMENT

Figure 1:
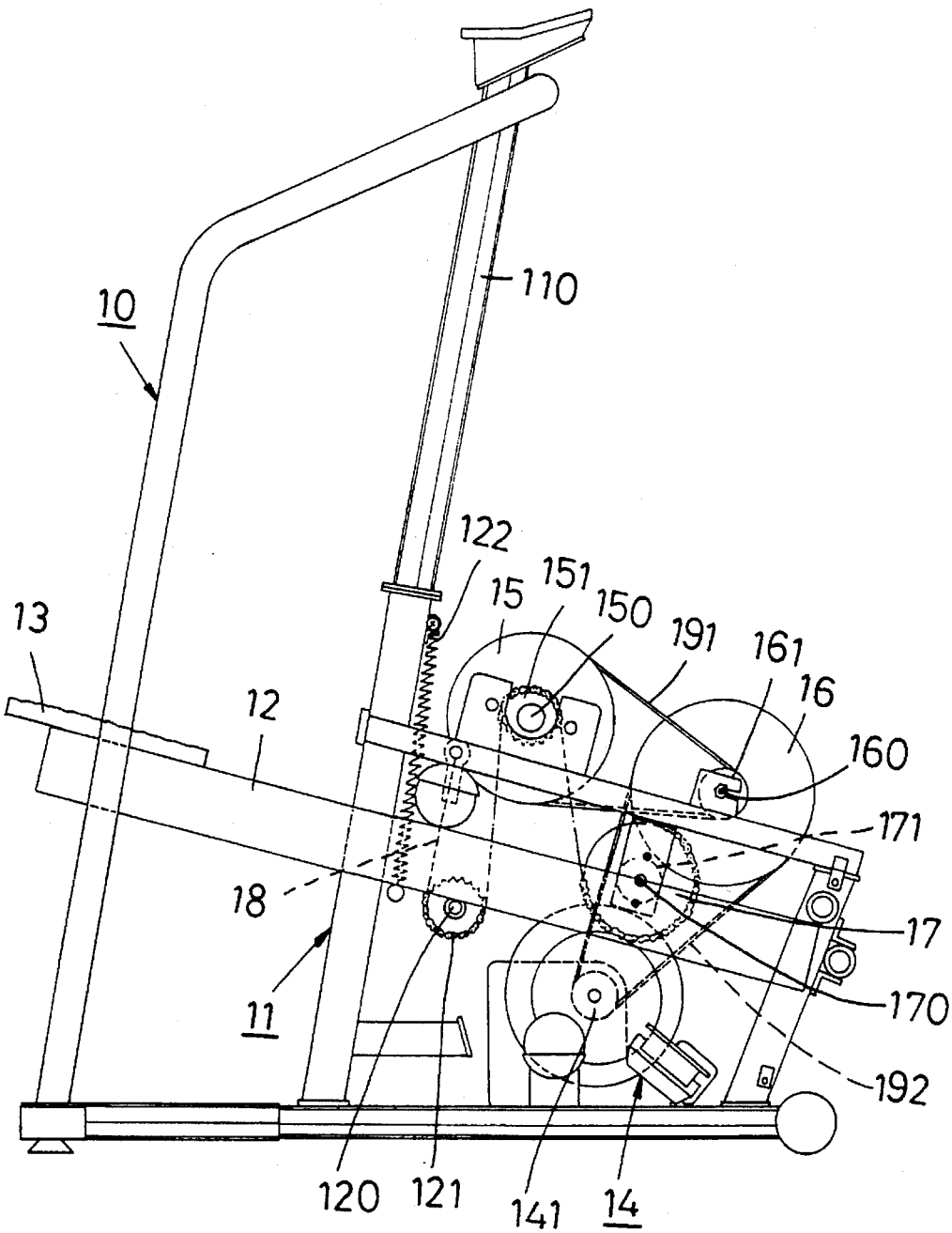
FIG. 1 PRIOR ART
FIG. 1 is a schematic view of a conventional stepper.
Figure 2:
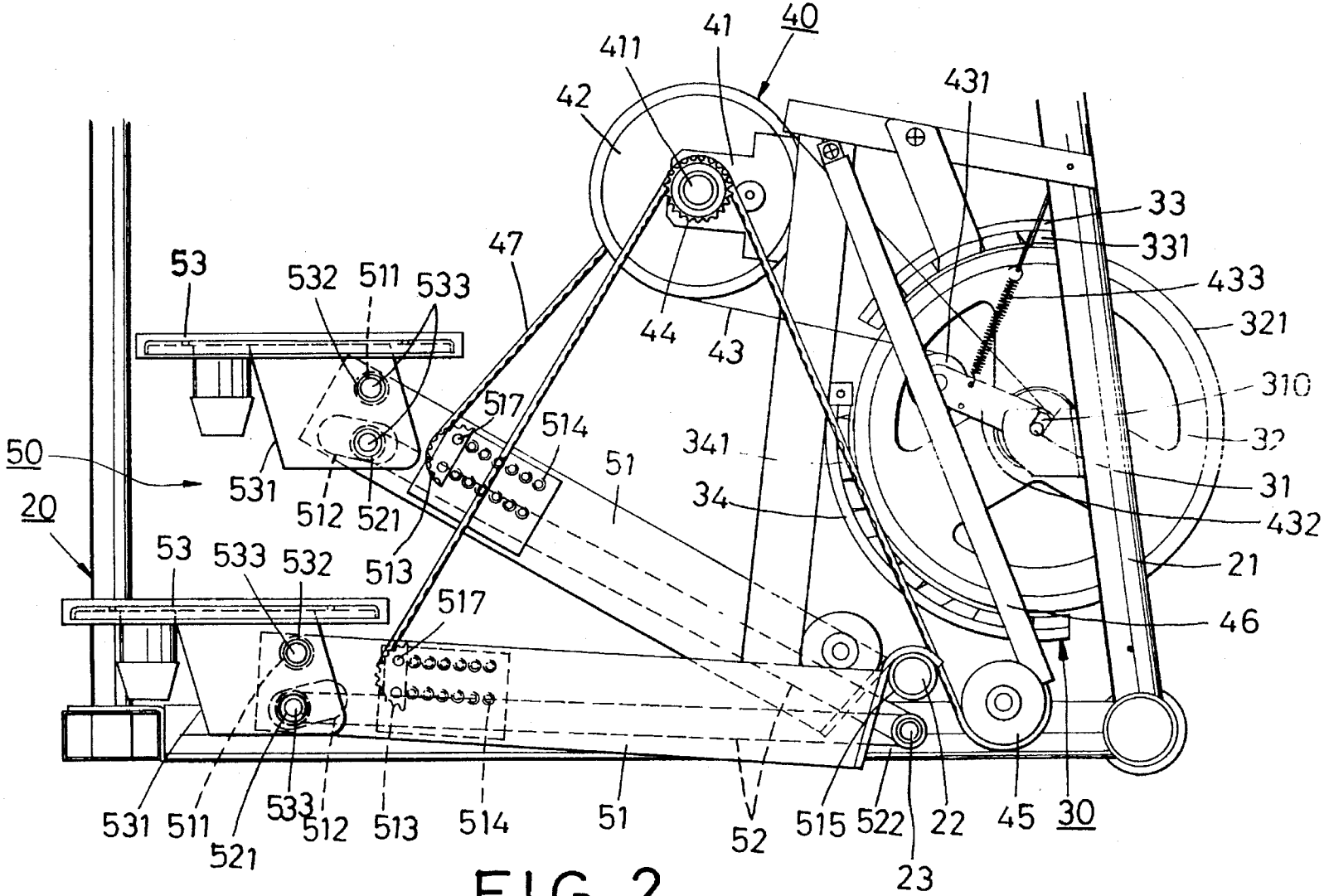
FIG. 2 is a fragmentary schematic view of the preferred embodiment of a stepper according to the present invention.

Referring to FIG. 2, the preferred embodiment of a stepper according to the present invention is shown to comprise a base frame 20, a magnet-type resistance unit 30, a transmission unit 40 and two pedal units 50.

The base frame 20 is adapted to be placed on a ground surface and includes a wheel supporting frame 21. The base frame 20 is further provided with a pair of lateral shafts 22, 23 that extend from each of two sides thereof.

The resistance unit 30 includes a driven shaft 31, a resistance wheel 32 and a pair of curved magnet seats 33, 34. The driven shaft 31 is journalled on the wheel supporting frame 21, and the resistance wheel 32 is secured on the driven shaft 31. The rim of the resistance wheel 32 is provided with a layer 321 of non-magnetic material. The magnet seats 33, 34 have one end mounted pivotally on the wheel supporting frame 21 and are disposed respectively above and below the resistance wheel 32. Each of the magnet seats 33, 34 has an inner face with a plurality of permanent magnets 331, 341 secured thereon. The permanent magnets 331, 341 provide resistance to rotation of the resistance wheel 32, as will be detailed in the succeeding paragraphs.

The transmission unit 40 is mounted on the wheel supporting frame 21 and includes a drive shaft 411, a first belt wheel 42, an endless drive belt 43, a pair of pinions 44 (only one is shown), a pair of guide rollers 45 (only one is shown), a pair of elastic straps 46 (only one is shown) and a pair of flexible racks 47 (only one is shown).

The drive shaft 411 is journalled on two bearing plates 41 that are mounted on the wheel supporting frame 21. The first belt wheel 42 is mounted on the drive shaft 411. The drive belt 43 is trained between the belt wheel 42 and a second belt wheel 310 that is mounted securely on the driven shaft 31. An elongated pivot plate 432 has a first end sleeved on the driven shaft 31 and a second end with a tension roller 431 mounted thereon. A tension spring 433 has a first end connected to the wheel supporting frame 21 and a second end connected to the pivot plate 432, thereby biasing the pivot plate 432 in a normal upwardly inclining position and permitting the tension roller 431 to press against the drive belt 43 to maintain the latter in a tensed state, thus resulting in smooth transmission. Each of the pinions 44 is mounted on a respective one of two end portions of the drive shaft 411. The guide rollers 45 are mounted rotatably on the base frame 20 on two sides of the wheel supporting frame 21. Each of the elastic straps 46 has a first end connected to the wheel supporting frame 21 and a second end connected to the first end of a respective one of the flexible racks 47. Each of the racks 47 is trained on one of the guide rollers 45 and meshes with a corresponding one of the pinions 44.

Figure 3:
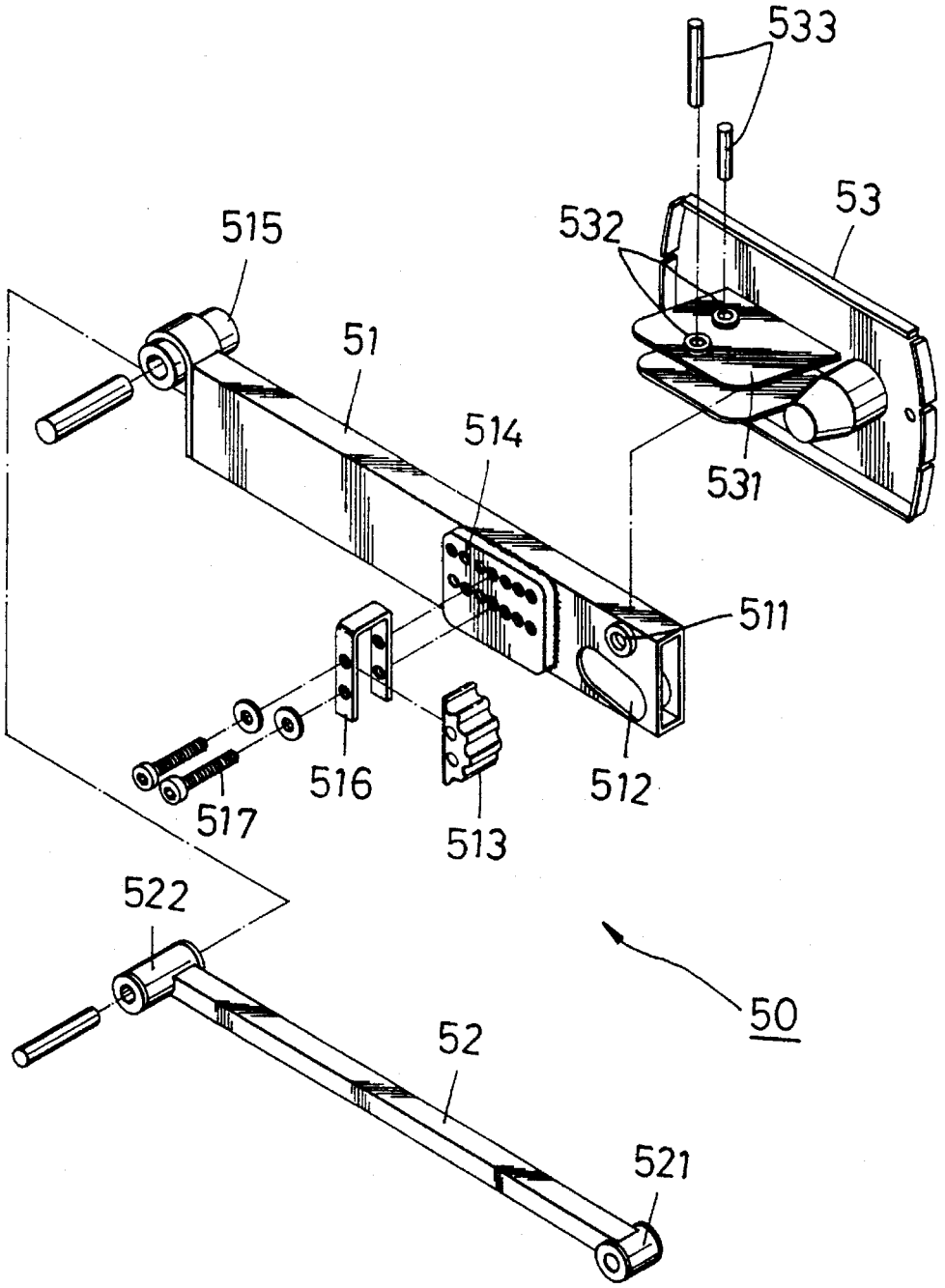
FIG. 3 is an exploded view illustrating a pedal unit of the preferred embodiment.

Referring to FIGS. 2 and 3, each of the pedal units 50 is disposed on a respective one of two sides of the wheel supporting frame 21 and includes a swing arm 51, a connecting rod 52 and a pedal body 53.

The swing arm 51 is formed as a hollow elongated shaft with a generally rectangular cross section. The swing arm 51 has a front end portion formed with a through-hole 511 and an elongated inclined slot 512, and an intermediate portion formed with two rows of aligned screw holes 514 for mounting a semi-circular pinion 513 thereon. The swing arm 51 further has a rear end portion formed with a tubular sleeve 515. The pinion 513 is mounted on a selected pair of the screw holes 514 via a U-shaped bracket 516 and a pair of screw fasteners 517. A respective one of the flexible racks 47 is trained on the pinion 513 and has a distal end clamped between the bracket 516 and the pinion 513, thereby connecting the flexible rack 47 to the swing arm 51. By varying the position of the pinion 513 on the swing arm 513, the tautness of a respective one of the elastic straps 46 and the respective one of the flexible racks 47 can be adjusted as desired.

The connecting rod 52 extends into the swing arm 51 and has a front end portion formed with a transverse shaft 521 that extends slidably into the inclined slot 512, and a rear end portion formed with a tubular sleeve 522. The tubular sleeves 515, 522 of the swing arm 51 and the connecting rod 52 are sleeved rotatably and respectively on the lateral shafts 22, 23 on a corresponding side of the base frame 20.

The pedal body 53 is provided with a spaced pair of downwardly extending connecting plates 531 to be disposed on two sides of the swing arm 51. Each of the connecting plates 531 is formed with a pair of through-holes 532 to be aligned respectively with the through-hole 511 and the elongated inclined slot 512 in the swing arm 51. One of two pins 533 extends through one of the through holes 532 in the connecting plates 531 and the through-hole 511 in the swing arm 51 to mount pivotally the pedal body 53 to the swing arm 51. The other one of the pins 533 extends through the other one of the through holes 532 in the connecting plates 531, the inclined slot 512 in the swing arm 51 and axially through the transverse shaft 521 of the connecting rod 52, thereby permitting retention of the pedal body 53 in a substantially horizontal position when the stepper of this invention is in use.

When pressure is applied on the pedal body 53 of one of the pedal units 50, the corresponding swing arm 51 and connecting rod 52 pivot about the lateral shafts 22, 23. A change in the inclination of the connecting rod 52 will cause the transverse shaft 521 thereof to slide from one end of the inclined slot 512 to the other, thereby causing the pedal body 53 to pivot so as to maintain the latter in a substantially horizontal position. At the same time, the flexible rack 47, which is trained on the pinion 513 that is mounted on the swing arm 51, is pulled, thereby stretching the corresponding elastic strap 46 and causing the drive shaft 411 to rotate by virtue of rotation of one of the pinions 44. The first belt wheel 42 rotates, thereby causing corresponding rotation of the second belt wheel 310 via the drive belt 43. Rotation of the second belt wheel 310 causes the driven shaft 31 to rotate, thereby rotating consequently the resistance wheel 32. Since the layer 321 of non-magnetic material on the rim of the resistance wheel 32 cuts into the magnetic lines of force that extend from the north poles to the south poles of the permanent magnets 331, 341 on the inner face of the magnet seats 33, 34, the permanent magnets 331, 341 resist the rotation of the resistance wheel 32. The proximity of the magnet seats 33, 34 can be adjusted in a known manner to adjust correspondingly the resistance to rotation of the resistance wheel 32. The closer the magnet seats 33, 34 are to the rim of the resistance wheel 32, the stronger will be the resistance force that is provided by the permanent magnets 331, 341 to the rotation of the resistance wheel 32.

When the pressure on the pedal body 53 is released, the corresponding elastic strap 46 retracts, thereby pulling the flexible rack 47 in an opposite direction to cause upward pivoting movement of the corresponding swing arm 51 and connecting rod 52 about the lateral shafts 22, 23.

The advantages of the stepper of this invention are as follows:

1. The pedal bodies 53 can be maintained in a substantially horizontal position when the stepper is in use, thereby minimizing the risk that the user will lose his or her balance when exercising on the stepper of this invention.

2. In order to enable the resistance unit 30 to resist downward pivoting movement of the pedal units 50, two sets of pinions 513, 44, two flexible racks 47, and two belt wheels 42, 310 are employed. Thus, the stepper of this invention is less complicated in construction and is less expensive due to the fewer number of components used in the connection between the resistance unit 30 and the pedal units 50.

While the present invention has been described in connection with what is considered the most practical and preferred embodiment, it is understood that this invention is not limited to the disclosed embodiment, but is intended to cover various arrangements included within the spirit and scope of the broadest interpretation so as to encompass all such modifications and equivalent arrangements.

I claim:

1. A stepper, comprising:

a base frame;

a pair of pedal units, each including: a hollow swing arm having a front end portion formed with a through-hole and an elongated inclined slot, and a rear end portion mounted pivotally on said base frame; a connecting rod extending into said swing arm and having a front end portion formed with a transverse shaft that extends slidably into said inclined slot, and a rear end portion mounted pivotally on said base frame; a pedal body provided with a spaced pair of downwardly extending connecting plates that confine said swing arm therebetween, each of said connecting plates being formed with a pair of through-holes to be aligned respectively with said through-hole and said inclined slot in said swing arm; a first pin extending through one of said through holes in said connecting plates and said through-hole in said swing arm to mount pivotally said pedal body to said swing arm; and a second pin extending through the other one of said through holes in said pedal body, said inclined slot in said swing arm and axially through said transverse shaft of said connecting rod;

a transmission unit including: a drive shaft journalled on said base frame; two pinions mounted respectively on two end portions of said drive shaft;

two elastic straps, each having a first end connected to said base frame and a second end; and two flexible racks, each having a first end connected to said second end of a respective one of said elastic straps and a second end connected to said swing arm of a respective one of said pedal units, each of said racks meshing with a respective one of said pinions, said elastic straps and said flexible racks maintaining said swing arms of said pedal units in normal upwardly inclining positions, application of pressure on said pedal body of any one of said swing units resulting in downward pivoting movement of said swing unit and in rotation of said drive shaft due to movement of the respective one of said racks; and a resistance unit mounted on said base frame and connected to said drive shaft for providing resistance to rotation of said drive shaft;

whereby, said pedal bodies of said pedal units are maintained in a substantially horizontal position when said stepper is in use.

2. The stepper as claimed in claim 1, wherein said resistance unit comprises:

a driven shaft journalled on said base frame;

a resistance wheel secured on said driven shaft and having a rim provided with a layer of non-magnetic material; and a pair of curved magnet seats mounted on said base frame and disposed respectively above and below said resistance wheel, each of said magnet seats having an inner face with a plurality of permanent magnets secured thereon.

3. The stepper as claimed in claim 2, wherein said transmission unit further comprises a first belt wheel mounted on said drive shaft, a second belt wheel mounted on said driven shaft, and a drive belt trained between said first and second belt wheels, said first and second belt wheels and said drive belt interconnecting said resistance unit and said drive shaft.

4. The stepper as claimed in claim 3, wherein said transmission unit further comprises:

an elongated pivot plate having a first end sleeved on said driven shaft and a second end with a tension roller mounted thereon; and a tension spring having a first end connected to said base frame and a second end connected to said pivot plate to bias said pivot plate in a normal upwardly inclining position and permit said tension roller to press against said drive belt to maintain said drive belt in a tensed state.

5. The stepper as claimed in claim 1, wherein said transmission unit further comprises a pair of guide rollers mounted rotatably on said base frame and having a respective one of said racks trained thereon.

6. The stepper as claimed in claim 1, wherein each of said pedal units further comprises a semi-circular pinion, a U-shaped bracket and a pair of screw fasteners for mounting said bracket and said semi-circular pinion on said swing arm, each of said racks being trained on said semi-circular pinion of the respective one of said pedal units and having a distal end clamped between said bracket and said semi-circular pinion of the respective one of said pedal units.

7. The stepper as claimed in claim 6, wherein said swing arm of each of said pedal units has an intermediate portion formed with two rows of aligned screw holes, said screw fasteners of each of said pedal units engaging a selected pair of said screw holes to mount adjustably said semi-circular pinion and said bracket on said swing arm to adjust correspondingly tautness of the respective one of said elastic straps and the respective one of said flexible racks.

* * * * *